United States Patent [19]

Wilkinson

[11] Patent Number: 4,984,785

[45] Date of Patent: Jan. 15, 1991

[54] DEVICE FOR SIMULATING CLIMBING

[76] Inventor: William T. Wilkinson, Rte. 4, Box 205, Seaford, Del. 19973

[21] Appl. No.: 408,925

[22] Filed: Sep. 18, 1989

[51] Int. Cl.[5] ..... A63B 21/12

[52] U.S. Cl. ..... 272/70; 272/DIG. 4; 108/144

[58] Field of Search ..... 248/188.2, 188.6, 439; 108/119, 120, 144, 130, 132; 272/70, DIG. 4, 120

[56] References Cited

U.S. PATENT DOCUMENTS 3,232,253 1/1966 Winters ..... 108/144

4,561,652 12/1985 Wilkinson ..... 272/DIG. 4

4,648,593 3/1987 Wilkinson ..... 272/70

*Primary Examiner*—Stephen R. Crow

*Attorney, Agent, or Firm*—Connolly & Hutz

[57] ABSTRACT

A device for simulating climbing includes a support structure having a platform detachably secured thereto. A spacer is insertable between the support structure and the platform and in accordance with the position of the spacer the effective height of the platform may be adjusted. The spacer has different horizontal and vertical dimensions which provide height adjustability of the platform depending upon the orientation of the spacer.

7 Claims, 3 Drawing Sheets

DEVICE FOR SIMULATING CLIMBING

BACKGROUND OF INVENTION

There is a growing trend for health awareness. This awareness has led to various approaches for different types of exercise. A particularly superior type of exercise which has been recognized in recent times is climbing. In my U.S. Pat. Nos. 4,340,218; 4,561,652; 4,659,075; and 4,648,593, I have disclosed various approaches for achieving the simulation of climbing. In general, these approaches involve the use of a platform which functions as a single step whereby the user may repeatedly step up and step down from the platform in an exercise program. One of the advantages of such an exercise program would be the capability of adjusting the height of the platform so as to control the degree to which the user must step up and down. For example, in a progressive program a relative low height may be initially used and then the height could be gradually increased. The height adjustability would also be desirable to render the device usable for different size persons.

SUMMARY OF THE INVENTION

An object of this invention is to provide an exercise device for simulating climbing of the type disclosed in my prior patents wherein height adjustability is conveniently obtained.

A further object of this invention is to provide such a device which may be stored and transported in a compact condition.

In accordance with this invention, the device for simulation of climbing includes a support structure which would rest, for example, on a floor. Detachably secured to the support structure and above the support structure is a platform which functions as the step onto which and from which the user would step. In accordance with this invention a spacer is provided which may be positioned between the support structure and the platform in one of two positions, the result of which is to vary the effective height of the platform. The spacer may also be completely omitted so as to provide a yet lower height for the platform or the platform may be omitted and the support structure could function as an even lower step.

If desired, springs may be positioned below the platform to provide further exercise benefits.

THE DRAWINGS

DETAILED DESCRIPTION

Figure 5:
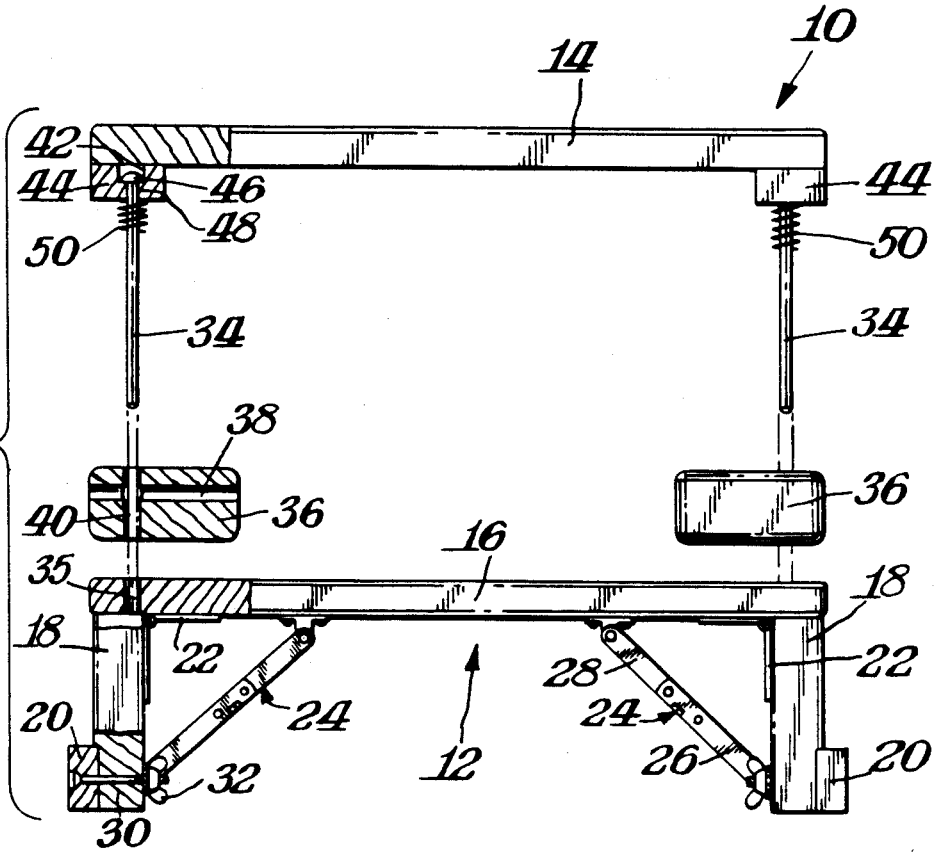
FIG. 5 is an exploded view, partly in sections, of the device shown in FIGS. 1–4.
Figure 8:
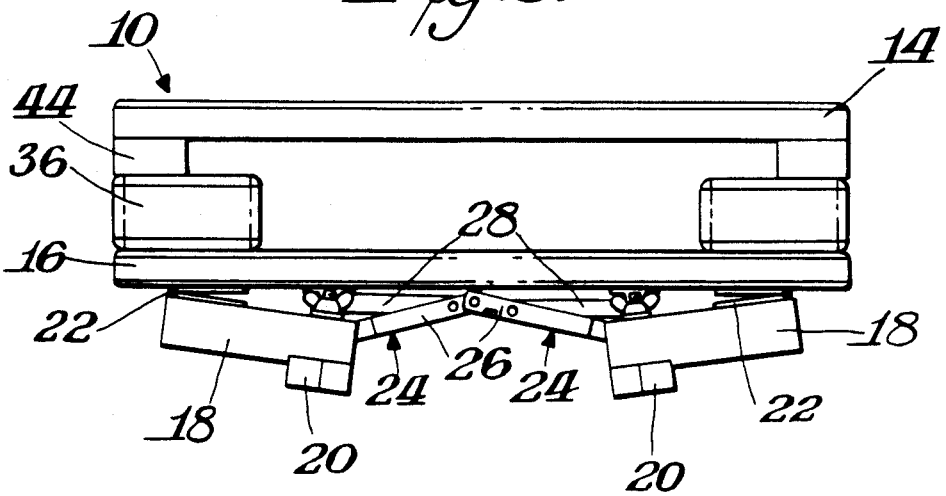
FIG. 8 is a side elevation view showing the device of FIGS. 1–6 in its stored condition.

Various figures illustrate a device 10 for the simulation of climbing. As shown therein, device 10 includes a lower support structure generally indicated by the reference numeral 12 with a platform 14 being detachably mounted thereto. Platform 14 functions as a step onto which and from which the user would step when performing the simulated climbing. As best shown in FIG. 5, support structure 12 includes a base member 16 having a pair of legs 18 at each end thereof which in turn is spanned by support members 20,20 for adding stability to device 10 while in use. Support structure 12 also includes hinge members 22 connecting the upper portion of legs 18 with base 16. Mounting units 24 connect the lower portion of legs 18 with base member 16 inwardly from the ends of base member 16 as clearly shown in FIG. 5. Mounting units 16 are of the type described in my U. S. Pat. No. 4,715,296 which generally includes a pair of links 26,28 hinged together in such a manner that legs 18 may be mounted in one of two selected positions. In the position shown in FIG. 5, legs 18 are vertically mounted during the condition of use of the device 10. In the position of FIG. 8, however, legs 18 are folded toward base 16 to provide a more compact unit during periods of storage or transportation.

Figure 7:
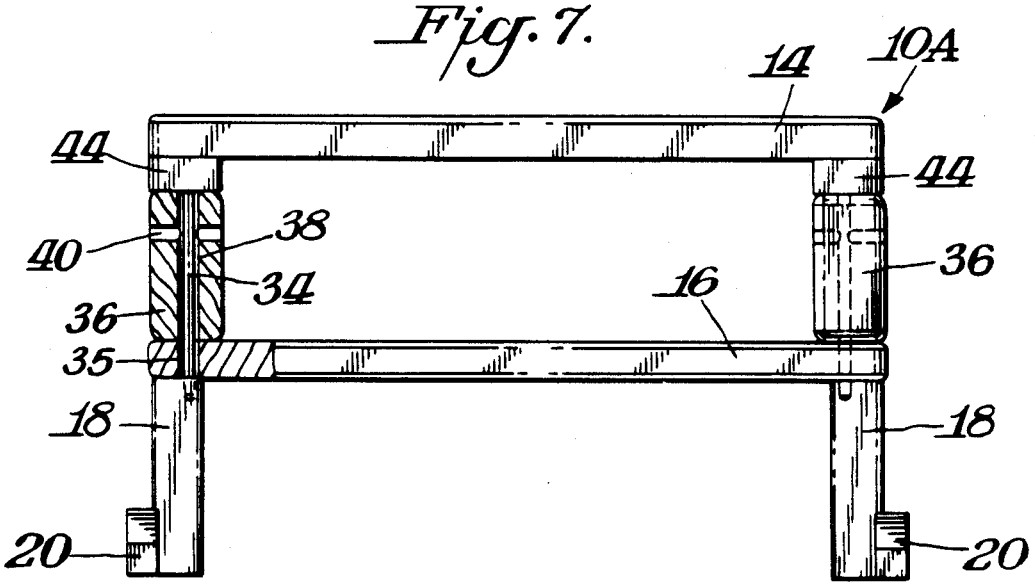

Alternatively, FIG. 7 illustrates device 10A to have its legs mounted in a non-hinged manner.

As also illustrated in FIG. 5 a bolt 30 extends through legs 18 to connect mounting units 24 with supports 20. Bolt 30 has a nut 32 secured thereto to detachably mount these parts together. As illustrated in FIG. 5 an elongated pin or rod 34 is connected to platform 14 and extends through hole 35 base 16.

Figure 6:
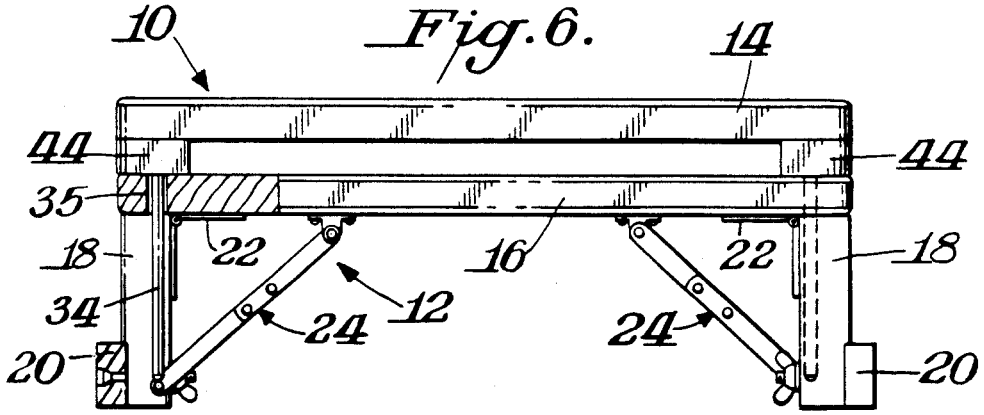
FIGS. 6–7 are side elevation views, partly in section, similar to FIG. 1 showing the device of FIGS. 1–5 in different operative conditions and with the device of FIG. 7 having non-hinged legs.

In accordance with this invention, a spacer 36 is detachably positioned between platform 14 and base 16 and each end thereof and extending completely thereacross. This detachable mounting of spacer 16 is accomplished by providing sets of cross holes 38,40 in spacer 36. Holes 38,40 are of a size to permit pin 34 to be readily inserted through a respective hole. In this manner, spacer 36 can be mounted in its horizontal or side position shown in FIG. 5 or in its upright or vertical position as shown in FIG. 7. Alternatively, as shown in FIG. 6 spacer 36 may be completely omitted.

As also shown in FIG. 5 pin 34 is secured to platform 14 by being trapped in a respective recess 42 in block 44 at each end of block 44. Pin 34 includes an enlarged head 46 which is dimensioned so that it is oversized with respect to the hole 48 in block 44. Thus, when blocks 44 are secured to the underside of platform 14, pins 34 are thereby securely attached to platform 14.

Device 10 through the use of spacer 36 is thus capable of providing the user with a step which may be disposed at one of four different selected heights. In the embodiment illustrated in FIG. 5 base 16 is located at a height of 6 inches. Base 16 itself may function as the step by completely omitting platform 14, pins 34 and spacers 36. When the user desires to increase the height device 10 may be operated in the condition shown in FIG. 6 where spacer 36 is omitted but platform 14 is still secured to base 16. For example, in this condition shown in FIG. 6, pins 34 extend substantially the length of legs 18. The combined height added by blocks 44 and the thickness of platform 14 is such that when platform 14 thereby functions as a step the height of the step is 8 inches.

Figure 2:
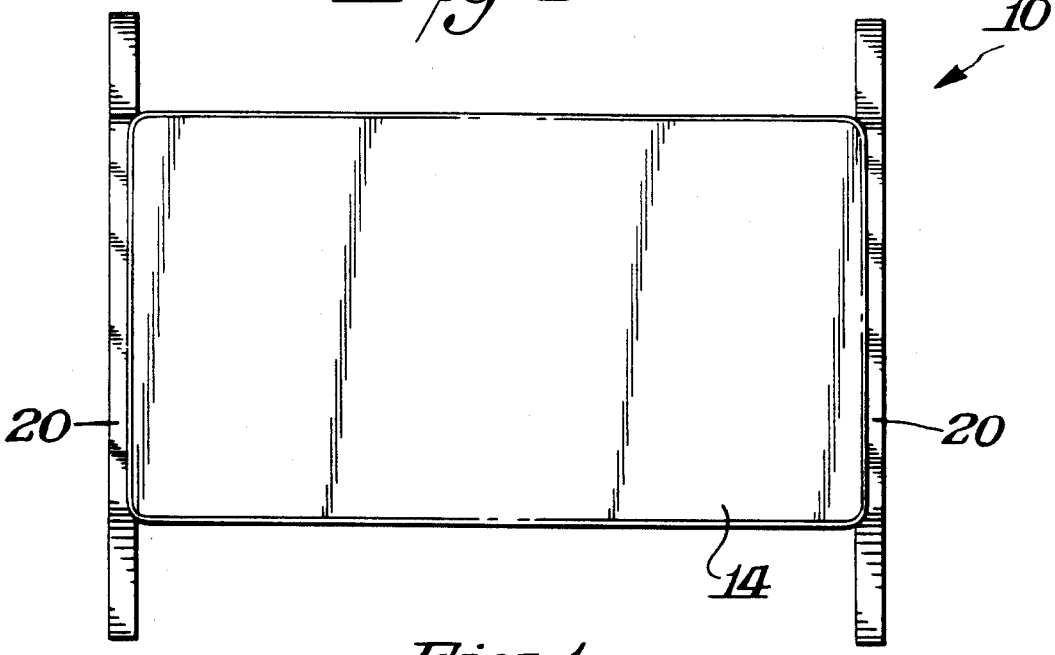
FIG. 2 is a top plan view of the device shown in FIG. 1.
Figure 1:
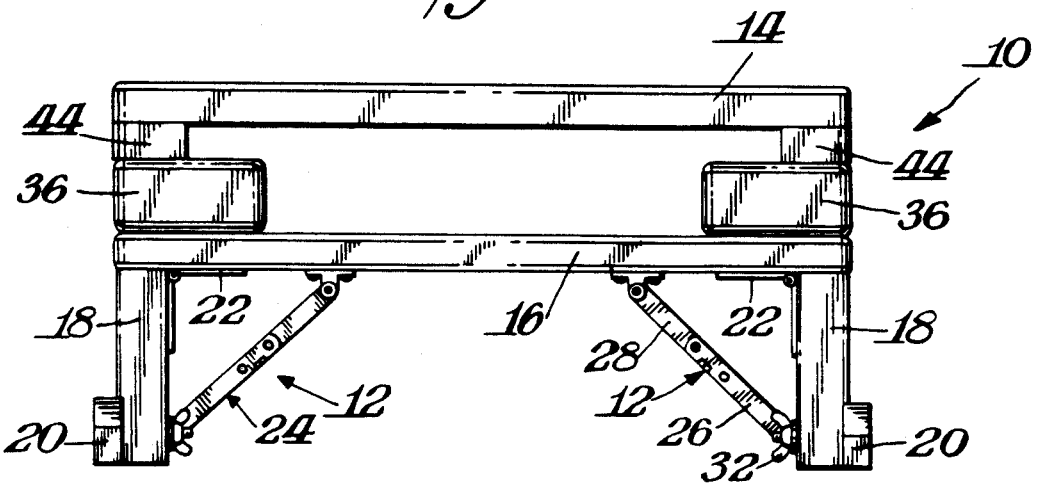
FIG. 1 is a front elevation view of a device for simulation of climbing in accordance with my invention.
Figure 3:
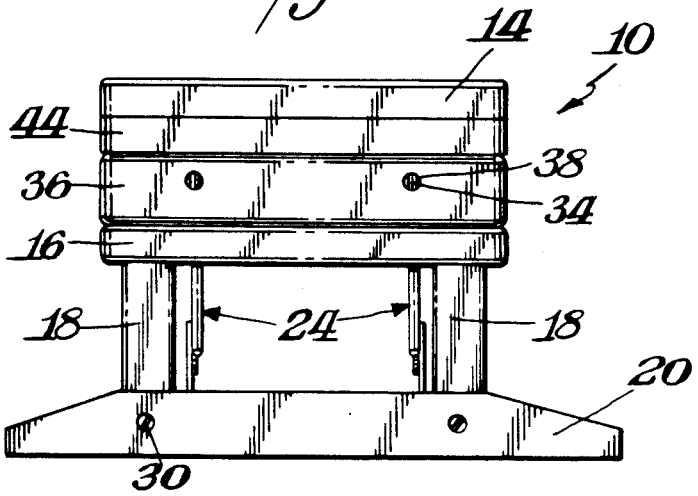
FIG. 3 is an end elevation view of the device shown in FIGS. 1–2.
Figure 4:
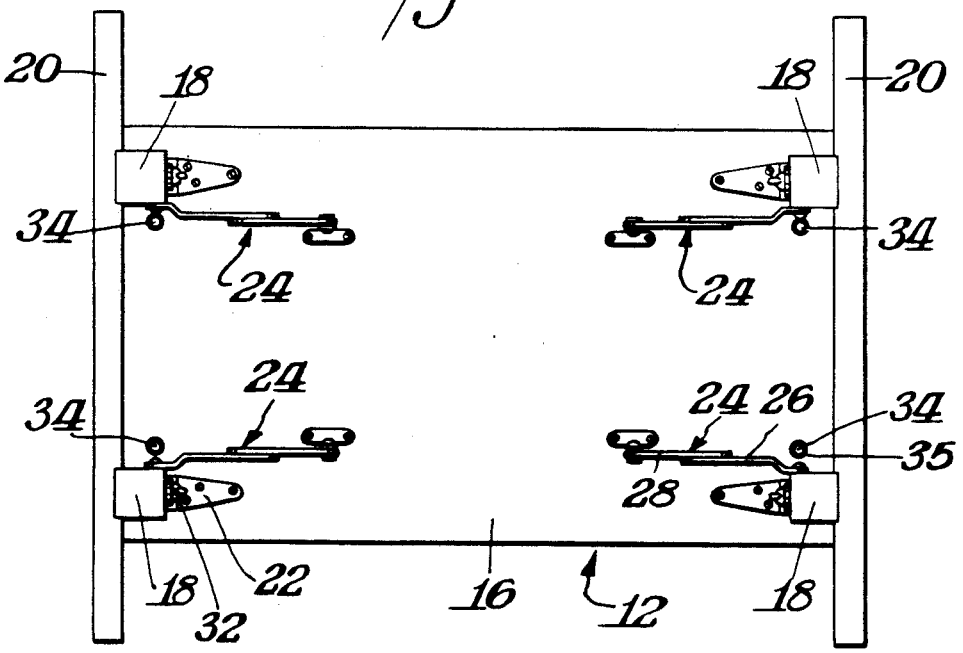
FIG. 4 is a bottom plan view of the device shown in FIGS. 1–3.

In the condition shown in FIG. 1 spacer 36 is mounted in its horizontal position and the thickness added by spacer 36 in this position is such that the height of platform 14 is 10 inches.

In the condition shown in FIG. 7 where spacer 36 is mounted in its upright or vertical position the height of platform 14 is 12 inches.

In accordance with this invention, the user is provided with yet another option in the use of device 10. As illustrated in FIG. 5 this option includes the possibility of providing springs 50 around each pin to provide a resilient force reacting between platform 14 and base 16 so that the climbing exercise is enhanced by the springiness of platform 14. The amount of resiliency or springiness can be controlled by the proper selection of the specific springs 50.

When it is desired to store or transport device 10 platform 14 is detached from support unit 12 and spacers 36 are also removed from base 16 of support unit 12. Legs 18 are collapsed toward base 16 by the manipulation of mounting units 24. It is preferred, however, that platform 14 and spacers 36 remain attached to support unit 12. Pins 34 are of a length so as not to extend beyond collapsed legs 18.

What is claimed is:

1. A device for simulation of climbing comprising a support unit, said support unit having a plurality of legs, a base secured to the top of said legs whereby said base may selectively function as a lowermost step on to which and from which a user may step during a simulated climbing exercise, a platform selectively disposed above and detachably connected to said base to provide an alternate step, and at least one spacer being selectively disposed between and detachably connected to said base and said platform for varying the distance said platform extends above said base to thereby permit the user to selectively adjust the height of the step; a plurality of said spacers being selectively positioned between said platform and said base, said spacers each having different horizontal and vertical dimensions and selectively mounted in one of two positions between said platform and said base, wherein a first hole extends through said horizontal dimension of said spacer and a second hole extends through said vertical dimension of said spacer, and a pin being mounted between said base and said platform and selectively extending through one of said holes of said spacer.

2. The device of claim 1 wherein one of said spacers is located at each end of said platform and extends completely across said platform.

3. The device of claim 2 including a mounting block secured to said platform at each end thereof selectively disposed against a respective spacer, and said pin being mounted to each of said blocks.

4. The device of claim 3 wherein each of said mounting blocks includes a pair of spaced recesses covered by said platform to create a pair of pockets, each of said pins extending through a respective mounting block and terminating in an enlarged head trapped in a respective pocket, and the opposite end of each pin extending through a respective hole in said base.

5. The device of claim 4 including a spring detachably mounted around each of said pins to provide a resilient force urging said platform away from said base.

6. The device of claim 5 wherein said legs are hingedly mounted to said base to permit said support unit to be in a collapsed condition.

7. The device of claim 1 including resilient means between said platform and said base urging said platform away from said base.

* * * * *